US006478593B2

(12) United States Patent
Miwa

(10) Patent No.: US 6,478,593 B2
(45) Date of Patent: Nov. 12, 2002

(54) CONNECTING TERMINAL

(75) Inventor: Takeya Miwa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/795,121

(22) Filed: Mar. 1, 2001

(65) Prior Publication Data

US 2001/0019911 A1 Sep. 6, 2001

(30) Foreign Application Priority Data

Mar. 2, 2000 (JP) ..... 2000-057295

(51) Int. Cl.[7] ..... H01R 13/53
(52) U.S. Cl. ..... 439/181; 439/862; 439/856
(58) Field of Search ..... 439/181, 186, 439/187, 856, 825, 826, 827, 862, 924.1; 218/6

(56) References Cited

U.S. PATENT DOCUMENTS 4,040,705 A * 8/1977 Huber ..... 439/397
4,973,273 A * 11/1990 DePriest ..... 439/856
5,947,773 A 9/1999 Karam

FOREIGN PATENT DOCUMENTS

WO WO 96/38885 12/1996
WO WO 96/38888 12/1996

* cited by examiner

*Primary Examiner*—Hien Vu
*Assistant Examiner*—Flix O. Figueroa
(74) *Attorney, Agent, or Firm*—Finnegan, Henderson, Farabow, Garrett, & Dunner, L.L.P.

(57) ABSTRACT

A connecting terminal provided with an arc discharge contact protruding forwardly and integrally formed at one side of a contact protrusion of a male terminal. The arc discharge contact comes into contact with the side surface of a side wall of a female terminal body before the contact protrusion of the male terminal comes into contact with a contact spring of the female terminal when the male terminal is connected to the female terminal.

5 Claims, 4 Drawing Sheets

CONNECTING TERMINAL

BACKGROUND OF THE INVENTION

1. Field of the Invention

This invention relates to a connecting terminal, more specifically, a connecting terminal for use in female and male connectors mutually mated for connection.

2. Description of the Related Art

A conventional connector in which a female connector and a male connector are fitted to each other for connection. The female connector has a female connector housing in which a male terminal is housed and fixed. The male terminal is disposed in such a manner that a tip as a contact protrusion is protruded into a hood of the female connector housing.

On the other hand, the male connector has a male connector housing in which a female terminal is housed and fixed. The female terminal has the front end formed in a tubular shape into which the tip of the male terminal can be inserted. The female terminal also has a connection spring piece at the front end, which piece is folded back obliquely into the internal space of the tube.

However in this connector, when the female connector and the male connector are mated in a conductive state, and the tip of the male terminal first makes contact with the front end of the female terminal, there occurs such a problem as to generate arc discharge at the contact to deteriorate or damage the contacts.

SUMMARY OF THE INVENTION

This invention has been achieved with such points in mind.

It is therefore an object of the invention to provide a connecting terminal with a contact protection function for preventing the deterioration or breakage of the front ends of terminals mutually connected, to protect the front ends of the terminals.

According to a first aspect of the present invention, there is provided a connecting terminal, comprising: a first and a second terminals with first and second contacts, the terminals being arranged to be electrically connected upon the contact between the contacts; and an arc discharge contact integrally formed at the first terminal, wherein the arc discharge contact being configured to make contact with a side surface of the second terminal before the first and second contacts come into contact with each other when the first and second terminals are connected; and wherein the arc discharge contact being configured to be detached from the side surface of the second terminal after the first and second contacts are detached from each other when the first and second terminals are disconnected.

Thus in this invention, the generation of arc discharge between the contacts can be prevented. As a result, the contacts of the terminals are protected from deterioration or damage due to arc discharge. That is, longevity of the terminals and the reliability of a connector holding the terminals are largely improved.

Therefore, the life cycle of the connecting terminal is elongated. Furthermore, the connector is improved in durability and reliability.

According to a second aspect of the invention, as it depends from the first aspect, wherein the first terminal is provided with a contact protrusion protruding forwardly, thereby the arc discharge contact is extended from one side of the contact protrusion and protrudes more than the contact protrusion in the forward direction; and wherein the second terminal is provided with a tubular member in which the contact protrusion is inserted, thereby the arc discharge contact comes into contact with a side surface of the tubular member when the first and second terminals are connected.

Thus in this invention, the contact inside the tubular member to be contacted with the contact protrusion is prevented from being subjected to arc discharge, being protected from deterioration and damage.

According to a third aspect of the invention, as it depends from the first or the second aspect, wherein the side wall is an outer side surface of a reinforced side wall of the second terminal.

Thus in this invention, the deterioration of or damage to the second terminal is prevented, resulting in high durability and normal long-term connection of the terminals.

According to a fourth aspect of the invention, as it depends from one aspect among the first to the third aspect, wherein the side wall is made of a bent conductive plate material constituting the tubular member.

Thus in this invention, a connecting terminal with high durability can be easily produced.

According to a fifth aspect of the invention, as it depends from one aspect among the first to the fourth aspect, the arc discharge contact is made of a conductive spring material with resiliency.

Thus in this invention, the tip of the arc discharge contact can be contacted with the side surface of the second terminal at a prescribed pressure.

According to a sixth aspect of the invention, as it depends from one aspect among the first to the fourth aspect, the arc discharge contact has a tip bent obliquely in the outward direction.

Thus in this invention, the arc discharge contact is certainly guided to abut against the side surface of the second terminal.

BRIEF DESCRIPTION OF THE ACCOMPANYING DRAWINGS

The above and further objects and novel features of the invention will more fully appear from the following detailed description when the same is read in conjunction with the accompanying drawings, in which.

DETAILED DESCRIPTION OF THE PREFERRED EMBODIMENT

With reference to the accompanying drawings, a connecting terminal according to this invention will now be described.

Figure 1:
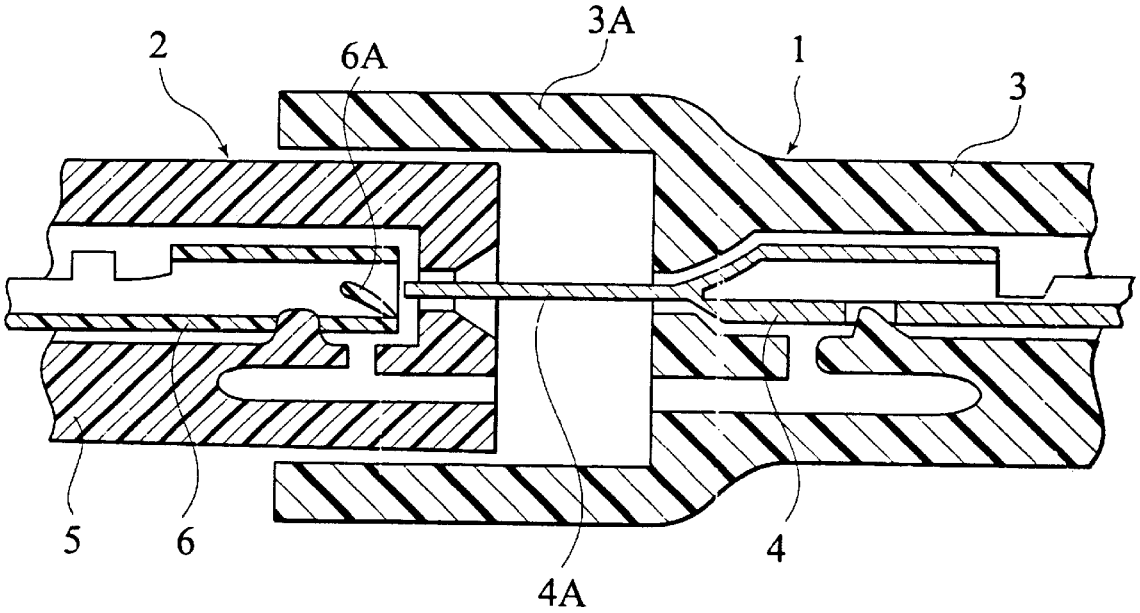
FIG.1 PRIOR ART
FIG. 1 is a sectional view showing one embodiment of a connector in which a terminal is adapted.

Referring to FIG. 1, an embodiment of a connector including a connecting terminal will be described hereinbelow. The figure shows a connector in which a female connector 1 and a male connector 2 are fitted to each other for connection. The female connector 1 has a female connector housing 3 in which a male terminal 4 is housed and fixed. The male terminal 4 is disposed in such a manner that a tip (contact protrusion) 4A is protruded into a hood 3A of the female connector housing 3.

On the other hand, the male connector 2 has a male connector housing 5 in which a female terminal 6 is housed and fixed. The female terminal 6 has the front end formed in a tubular shape into which the tip 4A of the male terminal 4 can be inserted. The female terminal 6 also has a connection spring piece 6A at the front end, which piece is folded back obliquely into the internal space of the tube.

In the connector of such a structure, when the male connector 2 is fitted into the female connector 1, the tip 4A of the male terminal 4 is inserted from the front end of the female terminal 6, to come into contact with the connection spring piece 6A as shown in FIG. 1, thereby to establish an electrical connection.

However in this connector, when the female connector 1 and the male connector 2 are mated in a conductive state, and the tip 4A of the male terminal 4 first makes contact with the front end of the female terminal 6, there slightly occurs such a problem as to generate arc discharge at the contact to deteriorate or damage the contacts. When the connectors are disengaged in a conductive state, the tip 4A of the male terminal 4 is lastly disengaged from the front end of the female terminal 6. This presents a problem of generating arc discharge at the corresponding part to deteriorate or damage the contacts.

The deterioration of or damage to the contacts prevents good electrical conductivity at the contact between the female and male terminals 4 and 6, resulting in a low degree of reliability of the connector.

In this connection, the inventor has improved the connector described above into a connector as another embodiment which will be described hereinbelow.

Figure 2:
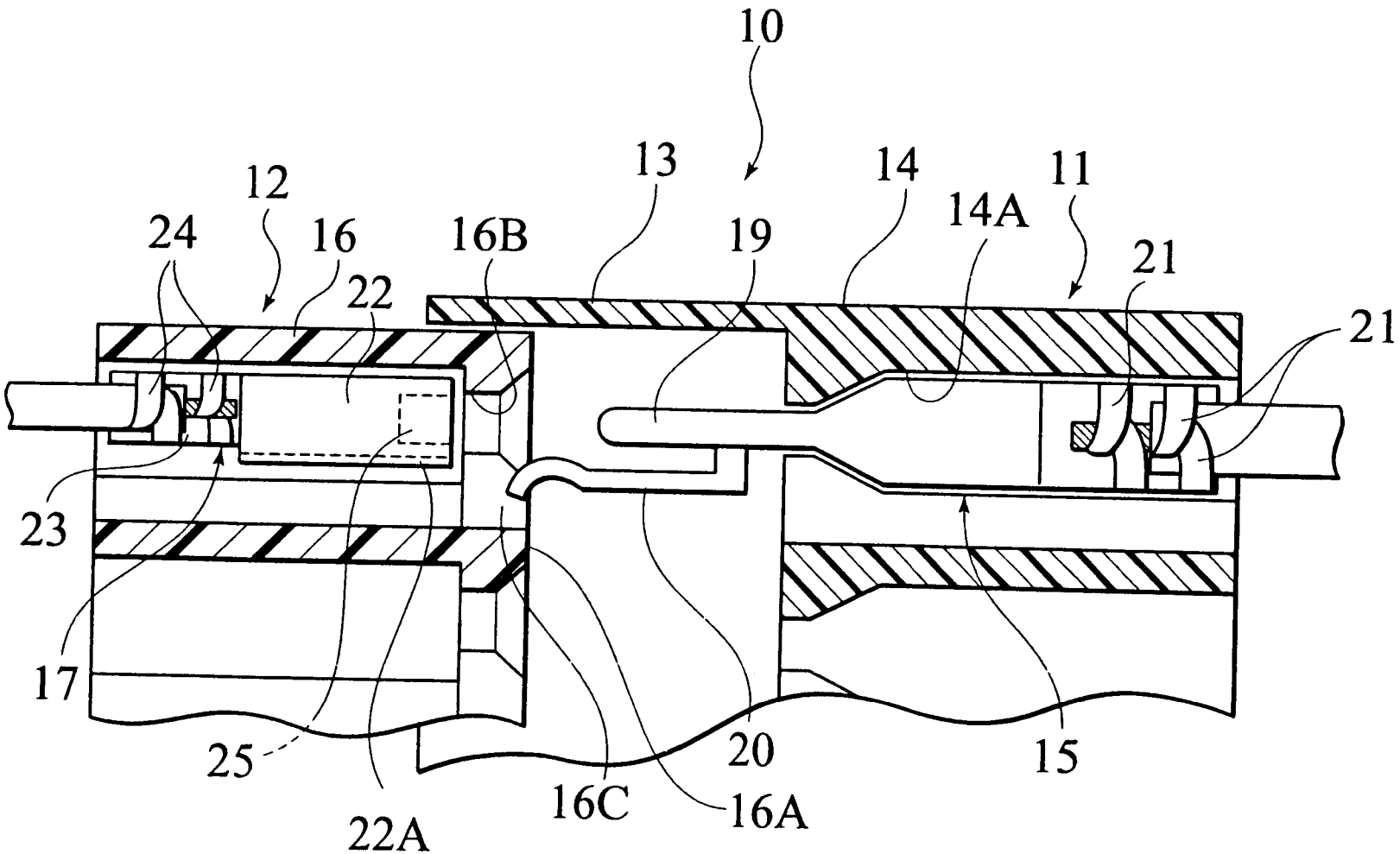
FIG. 2 is a sectional view showing a connector in which a connecting terminal according to another embodiment of the present invention is adapted.

In FIG. 2, the reference numeral 10 designates a connector. The connector 10 comprises a female connector 11 and a male connector 12.

The female connector 11 has a female connector housing 14 with a hood 13 formed at its front side in which a male terminal 15 (as a first terminal ) is housed. The male connector 12 has a male connector housing 16 to be fitted at its front side into the hood 13 of the female connector housing 14, in which housing 16 a female terminal 17 (as a second terminal ) is housed and arranged.

Figure 3:
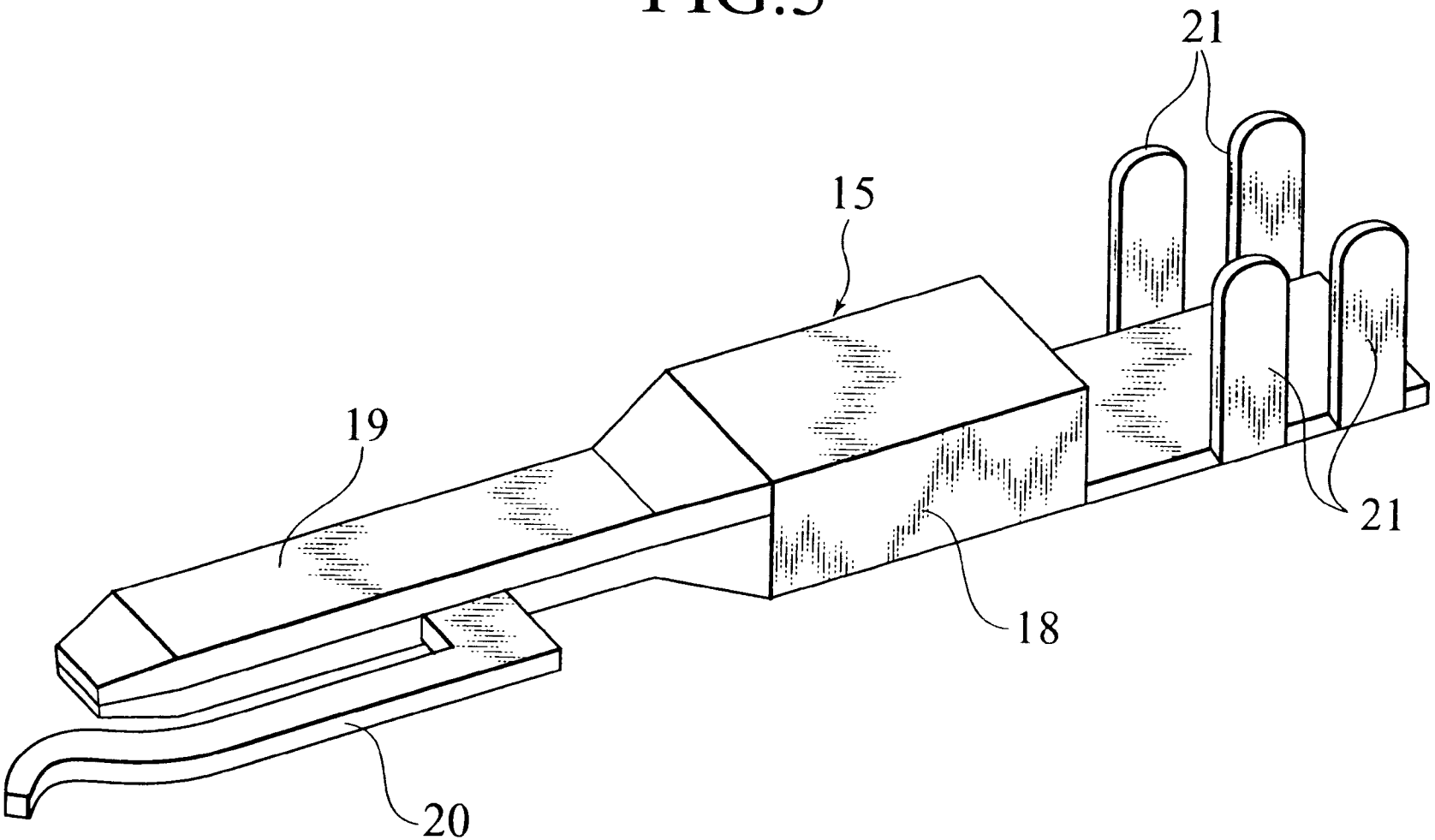
FIG. 3 is a perspective view showing a male terminal according to the embodiment of the invention.

As shown in FIGS. 2 and 3, the male terminal 15 consists of a male terminal body 18 held in the female connector housing 14 with a holding means not shown in the figures, a contact protrusion 19 provided at the front end of the male terminal body 18, an arc discharge contact 20 in a rod shape branched off from one side of the contact protrusion 19 and extending forwardly in substantially parallel with the contact protrusion 19 at a prescribed distance therefrom, and a plurality of (two in this embodiment) pairs of wire holding pieces 21 provided at the rear of the male terminal body 18 on opposites sides thereof in the transverse direction. The arc discharge contact 20 is configured to protrude more than the front end (contact) of the contact protrusion 19 in the forward connecting direction. The tip of the arc discharge contact 20 is bent in the outward direction.

The female connector housing 14 holding the male terminal 15 of such a structure includes a terminal housing space 14A. In the terminal housing space 14A, the male terminal body 18 of the male terminal 15 is housed. The contact protrusion 19 of the male terminal 15 protrudes from the terminal housing space 14A into the space of the hood 13. The arc discharge contact 20 of the male terminal 15, together with the contact protrusion 19, is disposed in the hood 13.

The male connector housing 16 has a front wall 16A at the front end surface, in which the female terminal 17 is inserted from the rear side thereof and held. The front wall 16A is provided in its center with a protrusion guide hole 16B penetrating in the cross direction. The front wall 16A is also provided with a contact insertion hole 16C to have the arc discharge contact 20 inserted therethrough.

Figure 4:
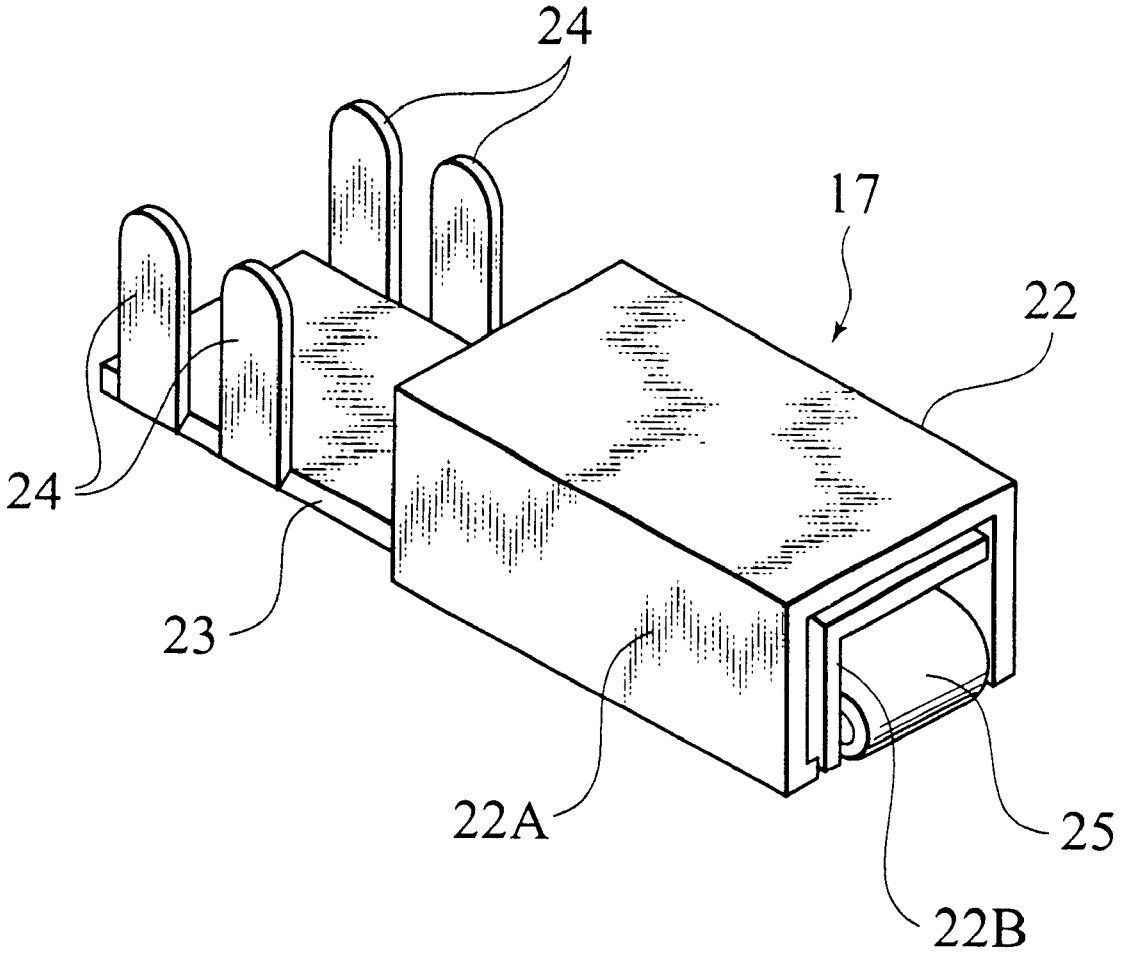
FIG. 4 is a perspective view showing a female terminal according to the embodiment of the invention.

As shown in FIGS. 2 and 4, the female terminal 17 held in the male connector housing 16 consists of a female terminal body 22 in a rectangular tube-like shape housed in the male connector housing 16 and held with a holding means not shown in the figures, a holding plate 23 extended to the rear of the male terminal body 22, and a plurality of pairs of wire holding pieces 24 formed on opposites sides of the holding plate 23. On the periphery of the front end opening of the female terminal body 22, a contact spring 25 as a contact folded back inwardly is provided. The contact spring 25 comes into contact with the contact protrusion 19 when the female and male connectors 11 and 12 are mated.

A side wall 22A of the female terminal body 22 is arranged to make contact with the arc discharge contact 20. The side wall 22A is made of a bent conductive plate material constituting the female terminal body 22 in such a manner that the conductive plate material is bent so as to be overlaid on an inside wall plate 22B. The female terminal body 22 is thus reinforced with the side wall 22A provided outside, thereby to protect the contact spring 25 inside the female terminal body 22 from the effect of arc discharge resulting from the contact between the tip of the arc discharge contact 20 and the side wall 22A.

In the connector 10 of such a structure, when the female connector 11 and the male connector 12 are mated, the tip of the arc discharge contact 20 comes into contact with the side surface of the side wall 22A of the female terminal body 22 before the contact protrusion 19 protruding into the hood 13 of the female connector housing 14 is inserted through the protrusion guide hole 16B in the front wall 16A of the male connector housing 16. At this time, arc discharge occurs between the tip of the arc discharge contact 20 and the side wall 22A. As a result, the contact protrusion 19 as an essential contact making contact with the contact spring 25 does not generate arc discharge. Thus the contact protrusion 19 and the contact spring 25 are prevented from being subjected to arc discharge and protected from deterioration or damage. The side wall 22A and the tip of the arc discharge contact 20 are subjected to deterioration or damage due to arc discharge, which fact presents no problem because they do not constitute essential contact.

This embodiment provides a connector with a contact protection function which is realized only by mounting a connecting terminal of this invention to a connector housing. Thus the connector 10 is improved in durability and reliability.

The entire contents of Japanese Patent Application 2000-057295 (filed on Mar. 2, 2000) are incorporated herein by reference.

Although the invention has been described above by reference to certain embodiment of the invention, the invention is not limited to the embodiment described above. Modifications and variations of the embodiment described above will occur to those skilled in the art, in light of the above teachings. The scope of the invention is defined with reference to the following claims.

What is claimed is:

1. A connecting terminal, comprising:

first and second terminals with first and second contacts respectively, the terminals being arranged to be electrically connected upon contact between the contacts;

an arc discharge contact integrally formed at the first terminal, wherein the arc discharge contact is configured to make contact with a side surface of the second terminal before the first and second contacts come into contact with each other when the first and second terminals are connected;

wherein the arc discharge contact is configured to be detached from the side surface of the second terminal after the first and second contacts are detached from each other when the first and second terminals are disconnected;

wherein the first terminal is provided with a contact protrusion protruding forwardly, so that the arc discharge contact is extened from one side of the contact protrusion and protrudes more than the contact protrusion in the forward direction; and wherein the second terminal is provided with a tubular member in which the contact protrusion is inserted, so that the arc discharge contact comes into contact with the side surface of the tubular member when the first and second terminals are connected.

2. A connecting terminal as set forth on claim 1, wherein the side surface is an outer side surface of a reinforced side wall of the second terminal.

3. A connecting terminal as set forth in claim 2, wherein the side wall is made of a bent conductive plate material constituting the tubular member.

4. A connecting terminal as set forth in claim 3, wherein the arc discharge contact is made of a conductive spring material with resiliency.

5. A connecting terminal as set forth in claim 3, wherein the arc discharge contact has a tip bent obliquely in the outward direction.

* * * * *

UNITED STATES PATENT AND TRADEMARK OFFICE

CERTIFICATE OF CORRECTION

PATENT NO. : 6,478,593 B2
DATED : November 12, 2002
INVENTOR(S) : Takeya Miwa

It is certified that error appears in the above-identified patent and that said Letters Patent is hereby corrected as shown below:

Column 5,
Line 21, "extened" should read -- entended --.

Column 6,
Line 8, "on claim 1," should read -- in claim 1, --.

Signed and Sealed this

Eighteenth Day of March, 2003

JAMES E. ROGAN
*Director of the United States Patent and Trademark Office*